US011259617B2

(12) United States Patent
Hwang et al.

(10) Patent No.: US 11,259,617 B2
(45) Date of Patent: Mar. 1, 2022

(54) DEVICE FOR DISPENSING AND APPLYING A PRODUCT

(71) Applicant: Crystal International (Group) Inc.

(72) Inventors: Roger Hwang, Maple (CA); Stephen M Fisher, II, Sherman, CT (US); William Lloyd Alusitz, Yorktown Heights, NY (US); Cy Wang, Zhongshan (CN); Scott Guo, Foshan (CN)

(73) Assignee: CRYSTAL INTERNATIONAL (GROUP), INC., Scarborough (CA)

( * ) Notice: Subject to any disclaimer, the term of this patent is extended or adjusted under 35 U.S.C. 154(b) by 73 days.

(21) Appl. No.: 16/911,363

(22) Filed: Jun. 24, 2020

(65) Prior Publication Data

US 2021/0345754 A1 Nov. 11, 2021

(30) Foreign Application Priority Data

May 9, 2020 (CN) ..... 202020753004.8

(51) Int. Cl.

| | |
|---|---|
| ***B43K 5/02*** | (2006.01) |
| ***A45D 34/04*** | (2006.01) |
| ***A45D 40/26*** | (2006.01) |

(52) U.S. Cl.

CPC ..... *A45D 34/04* (2013.01); *A45D 34/043* (2013.01); *A45D 40/26* (2013.01); *A45D 40/264* (2013.01); *A45D 2200/051* (2013.01); *A45D 2200/055* (2013.01); *A45D 2200/056* (2013.01); *A45D 2200/1009* (2013.01)

(58) Field of Classification Search

CPC ..... A45D 34/04; A45D 34/043; A45D 40/26; A45D 40/264; A45D 2200/056; A45D 2200/1009

USPC ..... 401/188 R

See application file for complete search history.

(56) References Cited

U.S. PATENT DOCUMENTS

| | | | | |
|---|---|---|---|---|
| 6,334,727 | B1 | 1/2002 | Gueret | |
| 7,004,659 | B1 * | 2/2006 | Goodman | B05C 17/002 222/633 |
| 7,156,572 | B2 | 1/2007 | Gueret | |
| 8,267,610 | B2 * | 9/2012 | Goodman | B05C 17/002 401/202 |
| 9,585,459 | B2 * | 3/2017 | Kim | B05B 11/3069 |
| 9,826,813 | B2 * | 11/2017 | Lee | B01F 15/0227 |

(Continued)

*Primary Examiner* — Jennifer C Chiang

(74) *Attorney, Agent, or Firm* — Patterson + Sheridan, LLP

(57) ABSTRACT

A device for dispensing and applying a cosmetic product, the device includes a product dispensing assembly, an applicator which is configured to be coupled within an upper chamber of the product dispensing assembly in a removable manner, and a cap which is configured to be removably engaged with the product dispensing assembly for covering the applicator and the product dispensing assembly when the device is not in use. The applicator comprises an applicator element which is in contact with an intermediate receiving surface of the dispensing head of the product dispensing assembly. At least a portion of the applicator is placed in contact with the product delivered through at least one outlet of the dispensing head when the product dispensing assembly is actuated. Preferably, the product at least partially impregnates the applicator element when the product contacts the applicator element.

20 Claims, 6 Drawing Sheets

(56) References Cited

U.S. PATENT DOCUMENTS

| | | | | |
|---|---|---|---|---|
| 9,848,685 | B2 * | 12/2017 | Hwang | A46B 11/001 |
| 11,109,659 | B2 * | 9/2021 | Bruder | B65D 47/248 |

* cited by examiner

DEVICE FOR DISPENSING AND APPLYING A PRODUCT

CROSS-REFERENCE TO RELATED APPLICATION

This application claims benefit of Chinese Patent Application Serial No. 202020753004.8, filed on May 9, 2020, which is incorporated by reference in its entirety.

BACKGROUND

Field of the Invention

The present disclosure relates to a device for dispensing and applying a product, for example, a cosmetic product. The device is preferably used to dispense and apply products in the form of liquid, gel, and/or cream. For example, the device can be used to dispense and apply products, such as skin-care and hair-care products, make-up removers, and hair-coloring products.

Description of the Related Art

In the field of cosmetics, products such as milks, creams and gels, are preferably dispensed under pressure with a pump. Because of their instability in the presence of air, however, such products are preferably packaged in pump systems with no air intake (i.e., airless pumps). In other words, the products are packaged under vacuum in reservoirs, wherein the volume of the reservoir decreases as the product is used. Typically, the reservoir is a bag with retracting walls, a tube with deformable walls, or a bottle including a follower piston. Examples of suitable pumps include piston, diaphragm, and shutter type pumps.

To apply the product from a conventional dispensing system, the user dispenses the product from the reservoir onto her fingers and rubs it into the surface that is to be treated. Alternatively, the product is applied using an applicator, such as a foam applicator.

In systems having applicators that are designed to be reusable, it may be desirable for the applicator to be stored away from air between uses so that its mechanical properties (e.g., flexibility and/or absorptivity) are not adversely affected by air reacting with product residue remaining on the applicator. In particular, in the case of an applicator that is not cleaned after each use, product remaining on the applicator may react with the ambient air and/or other elements in the environment in which the applicator is kept. Additionally, residue remaining on the applicator may soil the applicator, thereby adversely affecting the product during the next use.

In the case of certain applicators, such as applicators shaped like the profile of the surface that is to be treated (e.g., the lips and/or the corner of the eye), it may be desirable for the product to be deposited on the applicator in the same way and in the same quantity so that the product can be consistently applied during each application.

U.S. Pat. No. 7,156,572 disclose a device for packaging and applying a substance comprising a receptacle for containing the substance and at least one housing in flow communication with the receptacle. The at least one housing may be configured to receive an applicator element and may comprise a side wall and an end wall. The device may also comprise at least one applicator element for applying the substance.

U.S. Pat. No. 6,334,727 disclose an applicator comprising a support which is configured to allow the applicator to be engaged with a container containing a first product, in the form of a gel, cream, or liquid, and an application member on the support. The application member is capable of conveying the first product from an opening defined by the support to an application face of the said application member. The applicator further includes a lid configured to removably cover the applicator member by engaging with the support.

In light of the foregoing, there is a need in the art for an improved device for dispensing and an applying a product. In particular, there is a need of a device which includes an applicator that is easy to transport and to handle and wherein the device allows the applicator to be kept substantially sealed from the external environment.

SUMMARY

Accordingly, there is provided a device including an applicator that is easy to transport and to handle and wherein the device allows the applicator to be kept substantially sealed from the external environment.

The device for dispensing and applying a product, allows the loading of the applicator with product in a manner which is reproducible.

Accordingly, there is provided a device for dispensing and applying a cosmetic product. The device comprises a product dispensing assembly, the applicator which is configured to be coupled within an upper chamber of the product dispensing assembly in a removable manner, and a cap which is configured to be removably engaged with the product dispensing assembly for covering the applicator and the product dispensing assembly when the device is not in use. Placement of the applicator on the product dispensing assembly positions the applicator with respect to at least one outlet so that at least a portion of the applicator is placed in contact with the product delivered through the at least one outlet when the product dispensing assembly is actuated. Preferably, the product at least partially impregnates the applicator when the product contacts the applicator.

According to an aspect of the present disclosure, the product dispensing assembly further comprises an outer container, an inner container, a pump assembly, a dispensing head, an annular sleeve, and a mounting structure.

According to an aspect of the present disclosure, the inner container is inserted into the outer container for accommodating the cosmetic product in the inner container; a pushing plate is inserted into an inner lower side of the inner container to push up the cosmetic product. The inner container is preferably a rigid, cylindrical body that is made of polypropylene. The cross-section of the inner container is circular. However, in other alternate embodiments the cross-section of the inner container may be oval, elliptical, or any other desired shape.

According to another aspect of the present disclosure, the annular sleeve is coupled to the upper portion of the outer container. More particularly, the outer container is formed in a cylindrical shape, in which an annular groove is formed on an upper inner periphery, thereby being coupled to the annular sleeve that comprises corresponding annular protrusion formed at an outer surface of a lower end portion of the annular sleeve. In alternate embodiments, the annular sleeve may be coupled to the upper portion of the outer container by any other coupling means known in the art. In yet other alternate embodiments, the annular sleeve and the outer container may be integral and made as one piece.

In present embodiment, the outer container has a circular cross-section. However, in other alternate embodiments the outer container may be ovoid, elliptical, or any other desired shape.

Further, the mounting structure is designed to fasten the pump assembly stably to a neck of the inner container. The dispensing head is coupled to an upper portion of the pump assembly. The dispensing head extends into inside space of the annular sleeve and wherein an upper portion of the dispensing head and the inside space of the annular sleeve forms the upper chamber to receive and retain the applicator therein in a removable manner.

Further, the applicator of the device includes a handle comprising a cavity, and an applicator element secured to said handle such that a proximal portion of the applicator element is received within the cavity of the handle by bonding, welding or by any other method known in the art. The applicator element is preferably made of a compressible material selected from a block of open-cell foam and sponge. The handle is made of a rigid material selected from a group of metal or plastic. In a preferred embodiment, the distal portion applicator element which is retained outside the cavity of the handle is dome in shape.

According to another aspect of the present disclosure, the mounting structure is preferably coupled to the inner container by snap-fastening. The mounting structure includes an outer skirt, an inner skirt, a central bore, and an upper transverse flange which connects the outer skirt to the inner skirt. An exterior surface of the inner skirt has a groove configured to snap-fasten with an inner bead of the neck of the inner container, and the outer skirt has an inner bead configured to snap-fasten with an outer groove on the neck of the inner container.

The pump assembly is installed through the central bore of the mounting structure. The pump assembly is preferably force-fitted, snap-fastened, and/or screw-fastened inside the central bore, thereby sealing pump assembly to the central bore of the mounting structure.

Further, the pump assembly comprises a cup shaped body, a hollow elongated stem, a spring, a retaining element, a check valve which is a one way valve, and an annular fluid-tight piston.

The pump assembly is designed to be fastened to the neck of the inner container containing said cosmetic product. The pump assembly comprises the cup-shaped body delimiting a chamber for suction/compression of the cosmetic product to be dispensed and in which the hollow stem extends at least partially.

The chamber is delimited by a wall of the cup-shaped body; a one-way valve, designed to close a hole for inlet of the product to be dispensed into said chamber from the inner container; the annular piston; and a widened end portion of the stem.

The cup shaped body comprises an outer flange which is received in an inner groove present in the central bore of the mounting structure for fixedly receiving the pump assembly in the central bore of the mounting structure. Further, an annular bead inside the central bore is coupled with a corresponding groove present above the outer flange of the cup shaped body for fixedly receiving the pump assembly in the central bore of the mounting structure.

The annular piston is slideable in a fluid-tight way on the inner surface of the chamber, and on a lower end of the hollow stem.

The spring has a top end which bears upon a projecting collar of the stem, which is made of a single piece with the stem at an upper end portion of said stem.

The retaining element retains a bottom end of said spring. The retaining element has a cylindrical shaped body having an outer portion that is fastened to the cup-shaped body at an inner stepped portion of the cup shaped body.

The annular piston being mobile between a first position and at least a second position, wherein in the first position the dispensing head is in a non-pressed state and wherein in the second position, the dispensing head is in a pressed state by application of downward push force on the handle of the applicator. In the first position, the annular piston closes in a fluid-tight way, under the thrust of said spring at least one hole that traverses the thickness of the stem in the proximity of its first end and opens into the cavity of the stem. More particularly, said piston bears in a fluid-tight way upon a widened end portion of the stem that is fastened to said stem and closes said cavity of the stem and blocks the connection between said chamber and the cavity of the stem itself.

In the second position, as the spring is compressed by pressing the dispensing head, the piston is raised away from said at least one hole of the stem and from said widened end portion of the stem, enabling the cosmetic product present in the chamber to be dispensed, passing through said hole and cavity made in the stem.

Further, as the downward push force is removed from the handle of the applicator, the dispensing head moves in upward direction as a result of which the spring again expands, the piston again closes the at least one hole of the stem and the product once again flows from the inner container into the chamber by suction pressure.

Preferably, the stem comprises at least one first hollow tubular element and one second hollow tubular element, which are partially inserted into one another and have features for e.g. corresponding groove and protrusion designed to fasten them together. The first tubular element extends at least partially on the outside of the cup-shaped body and has the collar for resting the first end of the spring. The second tubular element presents the inlet hole of the cavity of the stem and also comprises the widened end portion for resting of the piston.

Further, the pump assembly comprises a ring disposed at least partially within a top part of the cup shaped body. The ring has at least a protrusion on its outer surface that snap fits with a corresponding inner groove formed at the top part of the cup shaped body. The ring having an inwardly projecting rim for retention of the collar of the stem, which is designed to prevent exit of the stem from the cup shaped body under the thrust of the spring.

The first hollow tubular element of the stem has, at its top mouth an annular inner protrusion for snap coupling with a corresponding outer groove in a product passageway of the dispensing head.

In other embodiment the first hollow tubular element of the stem has, at its top mouth an annular groove for snap coupling with a corresponding outer protrusion in a product passageway of the dispensing head. In other embodiments, other coupling means like screw thread, force fit etc may also be used.

The spring, the piston, and the retaining element have a through hole so that they can be fitted on the stem.

According to another aspect of the present disclosure, the dispensing head is coupled to the stem and is axially movable with respect to the annular sleeve. The dispensing head is preferably cylindrical, and comprises an intermediate receiving surface with a lower skirt and an upper skirt extending substantially perpendicularly there from in an axial direction. The dispensing head is housed within the annular sleeve and has an outside diameter slightly lesser than the inside diameter of the annular sleeve. The lower skirt of the dispensing head is stepped inside from the upper skirt and an inner projection of the annular sleeve rests on an outer step formed on a bottom end of the lower skirt of the dispensing head when no downward push force is applied on the handle of the applicator. The dispensing head is configured to slide in downward direction with respect to the annular sleeve when the pump assembly is actuated by applying a downward push force on the handle of the applicator.

The intermediate receiving surface of the dispensing head is configured to receive the applicator and wherein the intermediate receiving surface is provided with the at least one outlet through which the pumped cosmetic product is discharged. The intermediate receiving surface of the dispensing head is concave, preferably shaped like a hemispherical cup. In other alternate embodiments, the intermediate receiving surface may be of any other shape having a cavity. The intermediate receiving surface may be smooth or may have reliefs, such as radial striations, grooves, channels, and/or ducts, which allow the product to be directed to points further away from the outlet than when the intermediate receiving surface is smooth.

According to another aspect of the present disclosure, the dispensing head has a product passageway which opens in the intermediate receiving surface via a central outlet in the intermediate receiving surface. The pump assembly being in fluid communication with the intermediate receiving surface via the product passageway and the at least one outlet when a downward push force is applied on the handle of the applicator to actuate the pump assembly.

The applicator is configured to be received inside the annular sleeve and upper skirt of the dispensing head such that the applicator element is adjacent to the intermediate receiving surface and the at least one outlet of the dispensing head. In one embodiment, the applicator element is compressed against the intermediate receiving surface when the applicator is placed on the product dispensing assembly.

According to yet another aspect of the present disclosure, when the applicator is received inside the annular sleeve, a distal end surface of the handle abuts a top edge of the upper skirt of the dispensing head so that when a downward push is applied on the handle of the applicator, the applicator and the dispensing head both slide in downward direction within the annular sleeve to actuate the pump assembly.

To use the device, the user disengages the cap and actuates the pump by applying downward push force to the dispensing head with the applicator. For example, the user firmly grips the outer container and presses the applicator. When fully actuated, the stem is depressed and a dose of product contained in the inner container is delivered. The product leaves the inner container via the pump assembly, the product passageway and the outlet, and is dispensed onto the intermediate receiving surface. The dispensed product then comes into contact with the applicator element. The product is transported along the intermediate receiving surface partly by capillary action and/or by pressure.

The user then removes the applicator from the upper chamber of the annular sleeve. In one embodiment, the applicator is a block of foam that is slightly compressed when the cap is on the product dispensing assembly. For this embodiment, the block of foam/sponge expands upon removal of the cap from the container, thereby facilitating the pumping out of some of the product that might not have been absorbed when the cap was closed. This expansion of the applicator element also makes it possible for at least a portion of the applicator element to be placed back in contact with the intermediate receiving surface for loading and/or reloading of the product onto the applicator element when the cap is not on the product dispensing assembly. To load the product, the applicator element is placed in contact with the intermediate receiving surface and the stem is actuated by moving the dispensing head towards the inner container.

The user preferably exerts slight pressure on the applicator element to expel the product from the pores of the applicator element, thereby transferring it to the surface to be treated. Before being repositioned, the applicator element of the applicator may be washed in a cleaning solution (e.g., under tap water) to clean it.

Additionally, the inner container may not be made in a single piece and may comprise a tubular body whose lower end is closed by a separate bottom plug.

According to an aspect of the present disclosure, the cap snap fits on the annular sleeve of product dispensing assembly. More particularly, the cap comprises an annular bead on an inner surface thereof that snaps onto at least one corresponding projection provided on an outer surface of the annular sleeve. However, in alternate embodiments the cap may be coupled with annular sleeve by any other means of coupling such as magnetic, threads etc.

The aforementioned disclosure is just one of embodiments and the present disclosure is not limited to the embodiments. It will be apparent to those having ordinary skills in the art in that various substitutions, deformations and modifications are construed to be available within the scope without departing from the disclosure.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
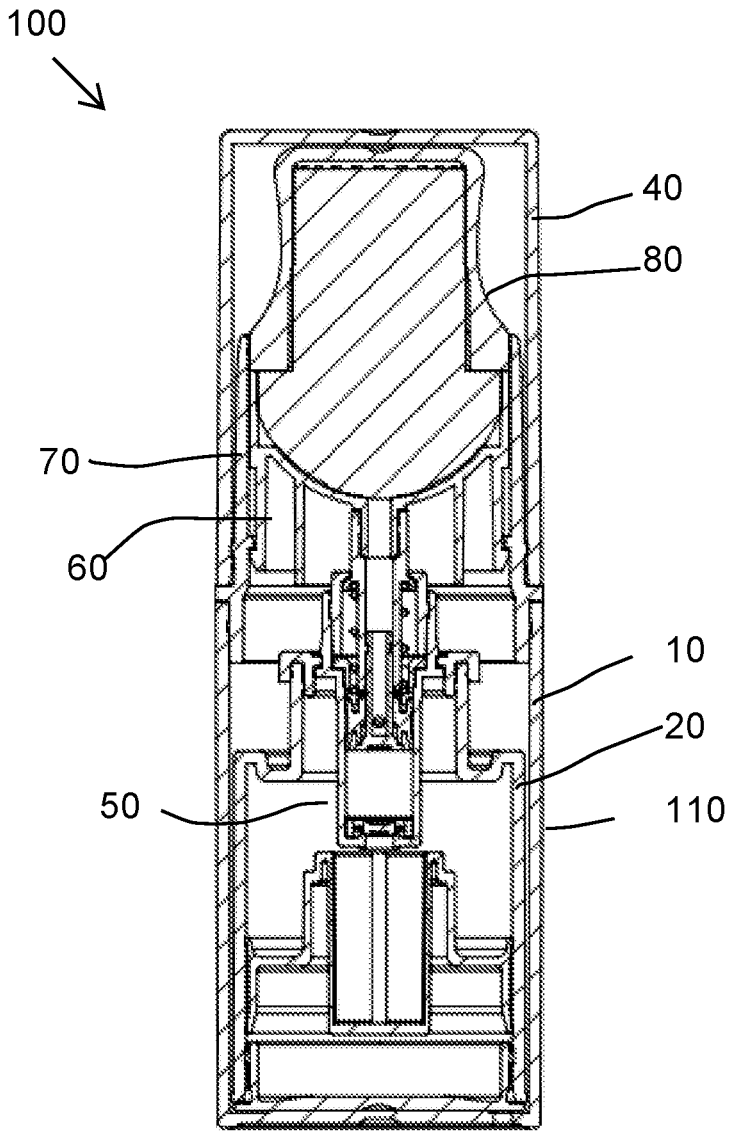
FIG. 1 shows a perspective cross sectional view of a device according to present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

FIGS. 1-8, show a device 100 for dispensing and applying a cosmetic product according to the present disclosure.

Figure 2:
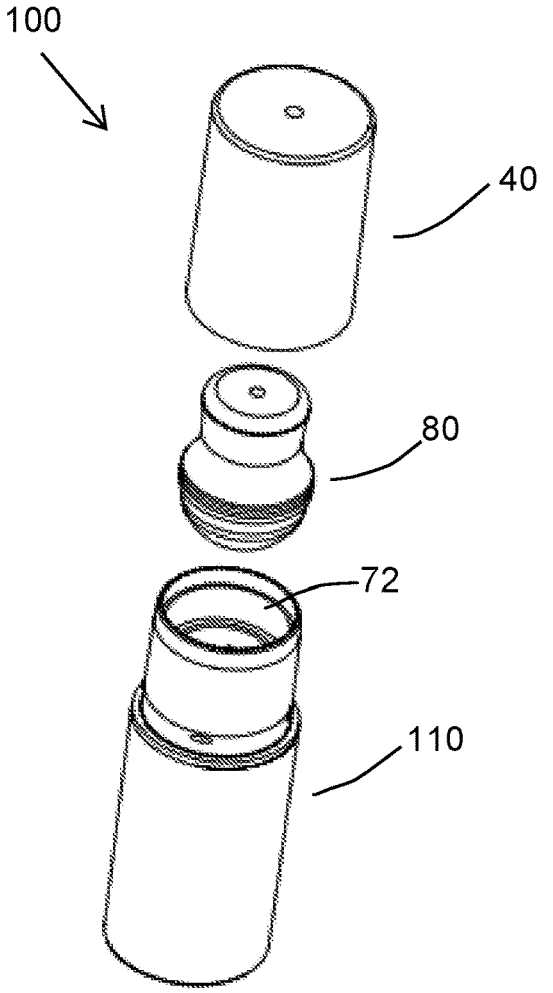
FIG. 2 shows a perspective view of the device of FIG. 1, with a cap and an applicator thereof in a disengaged state.
Figure 5:
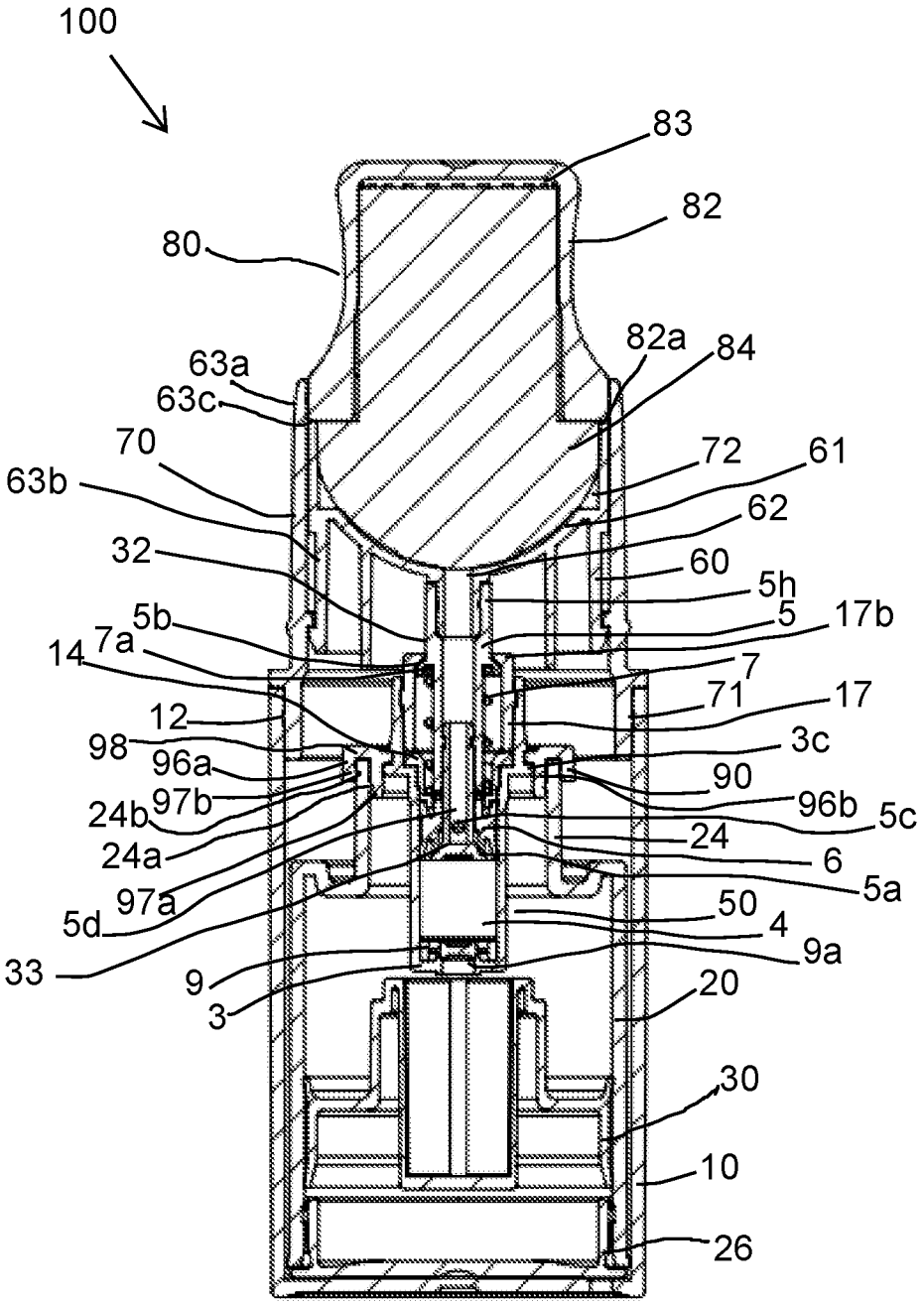
FIG. 5 shows a cross sectional view of the device of FIG. 4.

Referring to FIGS. 1 and 2, the device 100 comprises a product dispensing assembly 110, an applicator 80 which is configured to be coupled within an upper chamber 72 of the product dispensing assembly 110 in a removable manner, and a cap 40 which is configured to be removably engaged with the product dispensing assembly 110 for covering the applicator 80 and the product dispensing assembly 110 when the device 100 is not in use. Placement of the applicator 80 on the product dispensing assembly 110 positions the applicator 80 with respect to at least one outlet 62 as shown in FIG. 5 so that at least a portion of the applicator 80 is placed in contact with the product delivered through the at least one outlet 62 when the product dispensing assembly 110 is actuated. Preferably, the product at least partially impregnates the applicator when the product contacts the applicator 80.

As shown in FIGS. 5-8, the product dispensing assembly 110 further comprises an outer container 10, an inner container 20, a pump assembly 50, a dispensing head 60, an annular sleeve 70, and a mounting structure 90.

The inner container 20 is inserted into the outer container 10 for accommodating the cosmetic product in the inner container 20; a pushing plate 30 is inserted into an inner lower side of the inner container 20 to push up the cosmetic product. The inner container 20 is preferably a rigid, cylindrical body that is made of polypropylene. The cross-section of the inner container 20 is circular. However, in other alternate embodiments the cross-section of the inner container may be oval, elliptical, or any other desired shape.

Figure 4:
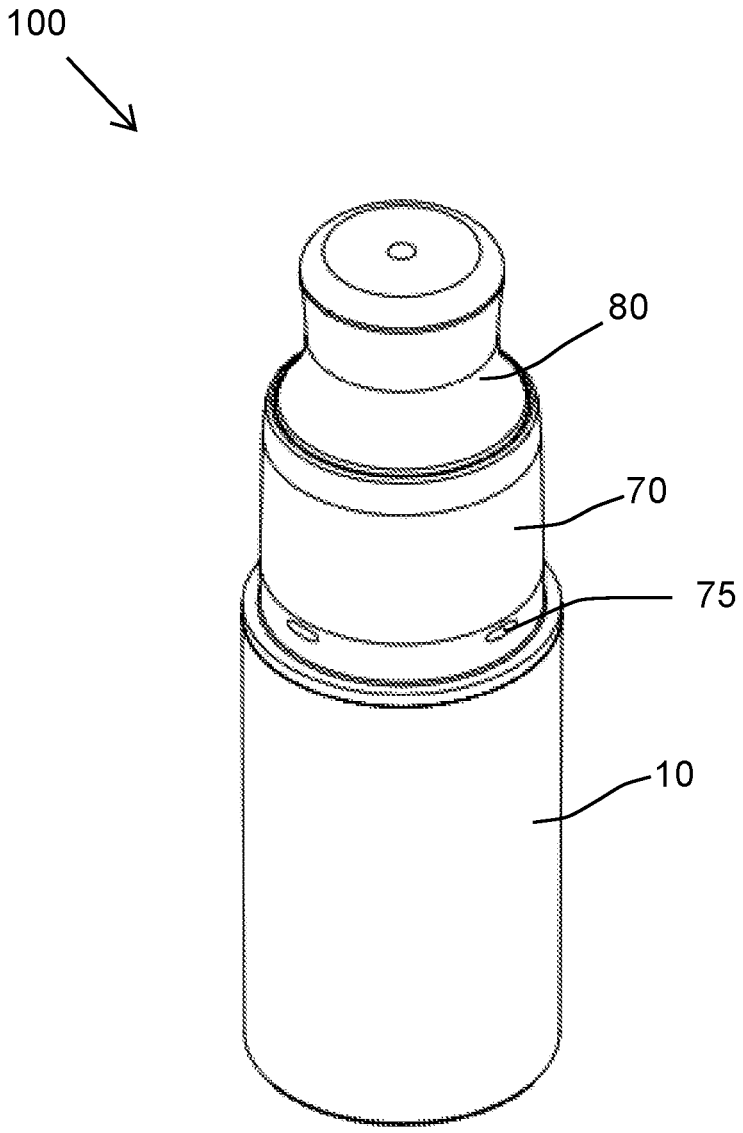
FIG. 4 shows a perspective view of the device of FIG. 1 without the cap.

As shown in FIGS. 4-5, the annular sleeve 70 is coupled to the upper portion of the outer container 10. More particularly, the outer container 10 is formed in a cylindrical shape, in which an annular groove 12 is formed on an upper inner periphery, thereby being coupled to the annular sleeve 70 that comprises corresponding annular protrusion 71 formed at an outer surface of a lower end portion of the annular sleeve 70. In alternate embodiments, the annular sleeve 70 may be coupled to the upper portion of the outer container 10 by any other coupling means known in the art. In yet other alternate embodiments, the annular sleeve 70 and the outer container 10 may be integral and made as one piece.

In present embodiment, the outer container 10 has a circular cross-section. However, in other alternate embodiments the outer container may be ovoid, elliptical, or any other desired shape.

Further, the mounting structure 90 is designed to fasten the pump assembly 50 stably to a neck 24 of the inner container 20. The dispensing head 60 is coupled to an upper portion of the pump assembly 50. The dispensing head 60 extends into an inside space of the annular sleeve 70 and wherein an upper portion of the dispensing head 60 and the inside space of the annular sleeve 70 forms the upper chamber 72 to receive and retain the applicator 80 therein in a removable manner.

Further, the applicator 80 of the device 100 includes a handle 82 comprising a cavity 83, and an applicator element 84 secured to said handle 82 such that a proximal portion of the applicator element 84 is received within the cavity 83 of the handle 82. The applicator element 84 is preferably made of a compressible material selected from a block of open-cell foam and sponge fixed to the handle 82 by bonding, welding or by any other method known in the art. The handle is made of a rigid material selected from a group of metal or plastic. In a preferred embodiment, the distal portion applicator element 84 which is retained outside the cavity 83 of the handle 82 is dome in shape. In other alternate embodiments, the distal portion of the applicator element 84 may be of any other shape having an outer surface corresponding to a surface of a cavity of the intermediate receiving surface 61 of the dispensing head 60.

As shown in FIG. 5, the mounting structure 90 is preferably coupled to the inner container 20 by snap-fastening. The mounting structure 90 includes an outer skirt 96*a*, an inner skirt 96*b*, a central bore 94 (see FIG. 6), and an upper transverse flange 98 which connects the outer skirt 96*a* to the inner skirt 96*b*. An exterior surface of the inner skirt 96*b* has a groove 97*a* configured to snap-fasten with an inner bead 24*a* of the neck 24 of the inner container 20, and the outer skirt 96*a* has an inner bead 97*b* configured to snap-fasten with an outer groove 24*b* on the neck 24 of the inner container 20.

The pump assembly 50 is installed through the central bore 94 of the mounting structure 90. The pump assembly 50 is preferably force-fitted, snap-fastened, and/or screw-fastened inside the central bore 94, thereby sealing the pump assembly 50 to the central bore 94 of the mounting structure 90.

Further, as shown in FIG. 5, the pump assembly 50 comprises a cup shaped body 3, a hollow elongated stem 5, a spring 7, a retaining element 14, a check valve 9 which is a one way valve, and an annular fluid-tight piston 6.

The pump assembly 50 is designed to be fastened to the neck 24 of the inner container 20 containing said cosmetic product. The pump assembly 50 comprises the cup-shaped body 3 delimiting a chamber 4 for suction/compression of the cosmetic product to be dispensed and in which the hollow stem 5 extends at least partially.

The chamber 4 is delimited by a wall of the cup-shaped body 3; a one-way valve 9, designed to close a hole 9*a* for inlet of the product to be dispensed into said chamber 4 from the inner container 20; the annular piston 6; and a widened end portion 5*a* of the stem 5.

The cup shaped body 3 comprises an outer flange 3*c* which is received in an inner groove (not visible) present in the central bore 94 of the mounting structure 90 for fixedly receiving the pump assembly 50 in the central bore 94 of the mounting structure 90. Further, as shown in FIG. 8, an annular bead 94*a* inside the central bore 94 is coupled with a corresponding groove 3*d* present above the outer flange 3*c* of the cup shaped body 3 for fixedly receiving the pump assembly 50 in the central bore 94 of the mounting structure 90.

The annular piston 6 is slideable in a fluid-tight way on the inner surface of the chamber 4, and on a lower end of the hollow stem 5.

The spring 7 has a top end 7*a* which bears upon a projecting collar 5*b* of the stem 5, which is made of a single piece with the stem 5 at an upper end portion of said stem 5.

Figure 8:
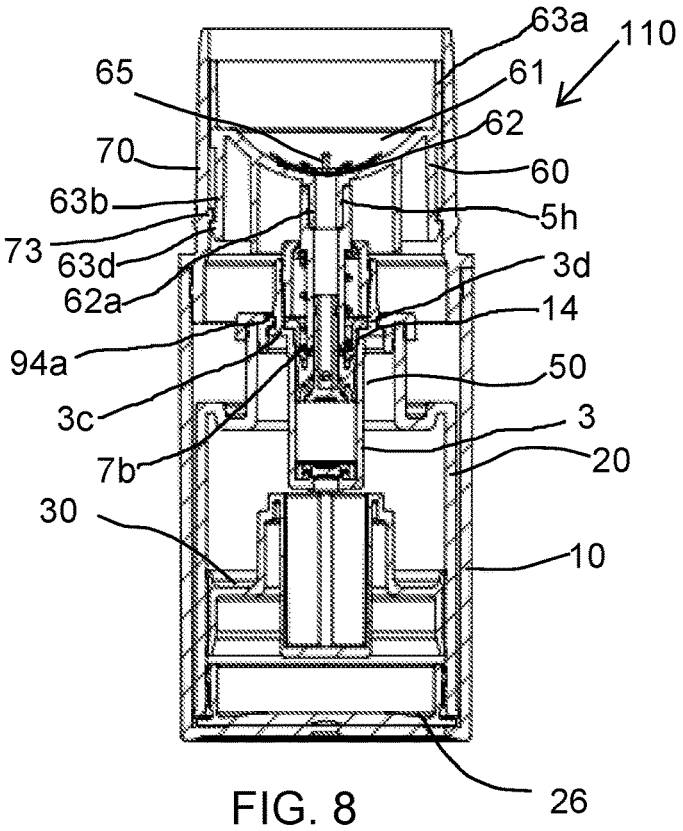
FIG. 8 shows a cross sectional view of the product dispensing assembly of FIG. 7.

The retaining element 14 retains a bottom end 7*b* of said spring 7 as shown in FIG. 8. The retaining element 14 has a cylindrical shaped body having an outer portion that is fastened to the cup-shaped body 3 at an inner stepped portion of the cup shaped body 3.

The annular piston 6 being mobile between a first position and at least a second position, wherein in the first position the dispensing head 60 is in a non-pressed state and wherein in the second position, the dispensing head 60 is in a pressed state. In the first position, the annular piston 6 closes in a fluid-tight way, under the thrust of said spring at least one hole 5*c* that traverses the thickness of the stem 5 in the proximity of its first end 5*a* and opens into the cavity 5*d* of the stem 5. More particularly, said piston 6 bears in a fluid-tight way upon the widened end portion 5*a* of the stem 5 that is fastened to said stem 5 and closes said cavity 5*d* of the stem 5 and blocks the connection between said chamber 4 and the cavity 5*d* of the stem 5 itself, as shown in FIG. 5.

In the second position, not shown, as the dispensing head 60 is pressed by applying downward push force on the handle 82 of the applicator 80, the spring 7 is compressed as a result of which the piston 6 is raised away from said at least one hole 5*c* of the stem 5 and from said widened end portion 5*a*, enabling the cosmetic product present in the chamber 4 to pass through said hole 5*c* and cavity 5*d* made in the stem 5 and dispensed through the at least one outlet 62 of the dispensing head 60.

Further, as the downward push force is removed from the handle 82 of the applicator 80, the dispensing head 60 moves in upward direction as a result of which the spring 7 again expands, the piston again closes the at least one hole 5*c* of the stem 5 and the product once again flows from the inner container 20 into the chamber 4 by suction pressure.

Preferably, the stem 5 comprises at least one first hollow tubular element 32 and one second hollow tubular element 33, which are partially inserted into one another and have features for e.g. corresponding groove and protrusion designed to fasten them together. The first tubular element 32 extends at least partially on the outside of the cup-shaped body 3 and has the collar 5*b* for resting the first end 7*a* of the spring 7. The second tubular element 33 presents the inlet hole 5*c* of the cavity 5*d* of the stem 5 and also comprises the widened end portion 5*a* for resting of the piston 6.

Further, the pump assembly 50 comprises a ring 17 disposed at least partially within a top part of the cup shaped body 3. The ring 17 has at least a protrusion on its outer surface that snap fits with a corresponding inner groove formed at the top part of the cup shaped body 3. The ring 17 having an inwardly projecting rim 17*b* for retention of the collar 5*b* of the stem 5, which is designed to prevent exit of the stem 5 from the cup shaped body 3 under the thrust of the spring 7.

As shown in FIG. 5 and FIG. 8, the first hollow tubular element 32 of the stem 5 has, at its top mouth an annular inner protrusion 5*h* for snap coupling with a corresponding outer groove in a product passageway 62*a* of the dispensing head 60. In other embodiment the first hollow tubular element 32 of the stem 5 has, at its top mouth an annular groove for snap coupling with a corresponding outer protrusion in a product passageway 62*a* of the dispensing head 60. In other embodiments, other coupling means like screw thread, force fit etc may also be used.

The spring 7, the piston 6, and the retaining element 14 have a through hole so that they can be fitted on the stem 5, see FIG. 5.

As shown in FIG. 5 and FIG. 8, the dispensing head 60 is coupled to the stem 5 and is axially movable with respect to the annular sleeve 70. The dispensing head 60 is preferably cylindrical, and comprises an intermediate receiving surface 61 with a lower skirt 63*b* and an upper skirt 63*a* extending substantially perpendicularly there from in an axial direction. The dispensing head 60 is housed within the annular sleeve 70 and has an outside diameter slightly lesser than the inside diameter of the annular sleeve 70. The lower skirt 63*b* of the dispensing head 60 is stepped inside from the upper skirt 63*a* and an inner projection 73 of the annular sleeve 70 rests on an outer step 63*d* formed on a bottom end of the lower skirt 63*b* of the dispensing head 60 when no downward push force is applied on the handle 82 of the applicator 80. The dispensing head 60 is configured to slide in downward direction with respect to the annular sleeve 70 when the pump assembly 50 is actuated by applying a downward push force on the handle 82 of the applicator 80.

The intermediate receiving surface 61 of the dispensing head 60 is configured to receive the applicator 80 and wherein the intermediate receiving surface 61 is provided with the at least one outlet 62 through which the pumped cosmetic product is discharged. The intermediate receiving surface 61 of the dispensing head 60 is concave, preferably shaped like a hemispherical cup as shown in the FIG. 5. In other alternate embodiments, the intermediate receiving surface may be of any other shape having a cavity. The intermediate receiving surface 61 may be smooth or may have reliefs, such as radial striations, grooves, channels, and/or ducts 65 (see FIG. 8), which allow the product to be directed to points further away from the outlet 62 than when the intermediate receiving surface 61 is smooth.

In the present embodiment, the dispensing head 60 has a product passageway 62*a* which opens in the intermediate receiving surface 61 via a central outlet 62 in the intermediate receiving surface 61 as shown in FIG. 8. The pump assembly 50 being in fluid communication with the intermediate receiving surface 61 via the product passageway 62*a* and the at least one outlet 62 when a downward push force is applied on the handle 82 of the applicator 80 to actuate the pump assembly 50.

The applicator 80 is configured to be received in the inside of the annular sleeve 70 and upper skirt 63*a* of the dispensing head 60 such that the applicator element 84 is adjacent to the intermediate receiving surface 61 and the at least one outlet 62 of the dispensing head 60. In one embodiment, the applicator element 84 is compressed against the intermediate receiving surface 61 when the applicator 80 is placed on the product dispensing assembly 110.

According to an aspect of the present embodiment and as shown in FIG. 5, when the applicator 80 is received inside the annular sleeve 70, a distal end surface 82*a* of the handle 82 abuts a top edge 63*c* of the upper skirt 63*a* of the dispensing head 60 so that when a downward push is applied on the handle 82 of the applicator 80, the applicator 80 and the dispensing head 60 both slide in downward direction within the outer sleeve 70 to actuate the pump assembly 50.

To use the device 100, the user disengages the cap 40 and actuates the pump 50 by applying downward push force to the dispensing head 60 with the applicator 80. For example, the user firmly grips the outer container 10 and pushes the applicator 80. When fully actuated, the stem 5 is depressed and a dose of product contained in the inner container 20 is delivered. The product leaves the inner container 20 via the pump assembly 50, the product passageway 62*a* and the outlet 62, and is dispensed onto the intermediate receiving surface 61. The dispensed product then comes into contact with the applicator element 84. The product is transported along the intermediate receiving surface 61 partly by capillary action and/or by pressure.

The user then removes the applicator 80 from the upper chamber 72 of the annular sleeve 70. In one embodiment, the applicator 80 is a block of foam that is slightly compressed when the cap 40 is on the product dispensing assembly 110. For this embodiment, the block of foam/sponge 84 expands upon removal of the cap 40 from the product dispensing assembly 110, thereby facilitating the pumping out of some of the product that might not have been absorbed when the cap 40 was closed. This expansion of the applicator element 84 also makes it possible for at least a portion of the applicator element 84 to be placed back in contact with the intermediate receiving surface 61 for loading and/or reloading of the product onto the applicator element 84 when the cap 40 is not on the product dispensing assembly 110. To load the product, the applicator element 84 is placed in contact with the intermediate receiving surface 61 and the stem 5 is actuated by moving the dispensing head 60 towards the inner container 20.

The user preferably exerts slight pressure on the applicator element 84 to expel the product from the pores of the applicator element 84, thereby transferring it to the surface to be treated. Before being repositioned, the applicator element 84 of the applicator 80 may be washed in a cleaning solution (e.g., under tap water) to clean it.

Figure 6:
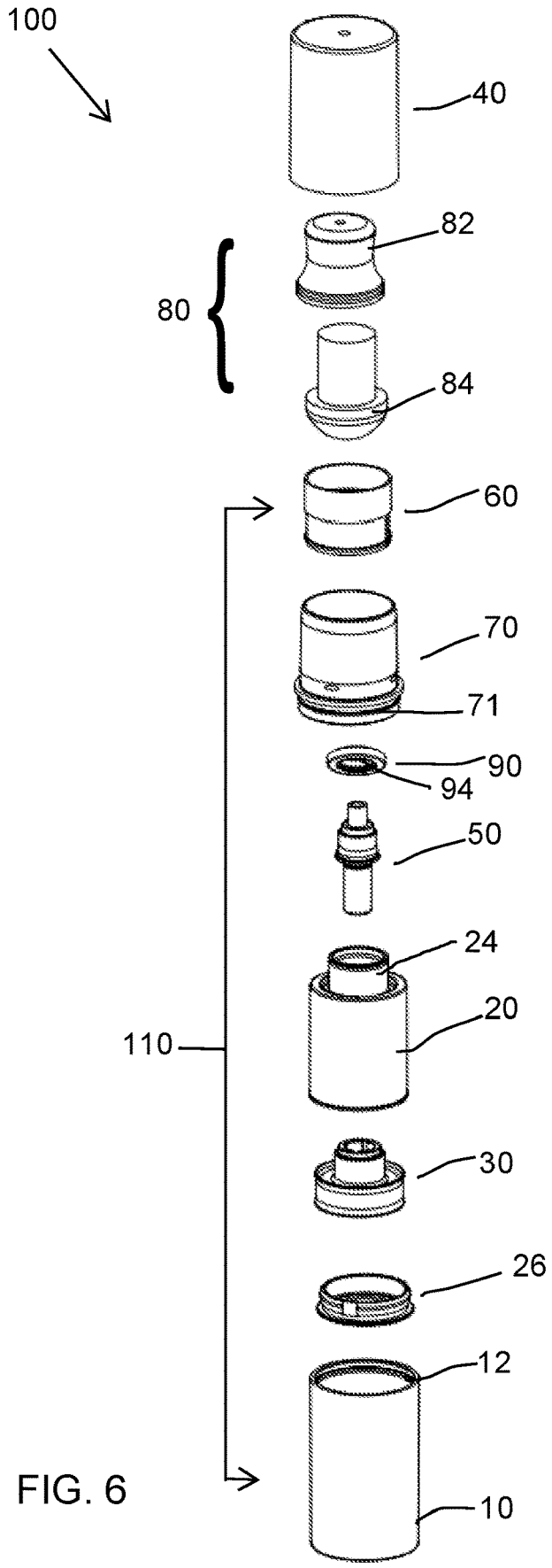
FIG. 6 shows an exploded view of the device of FIG. 1.
Figure 7:
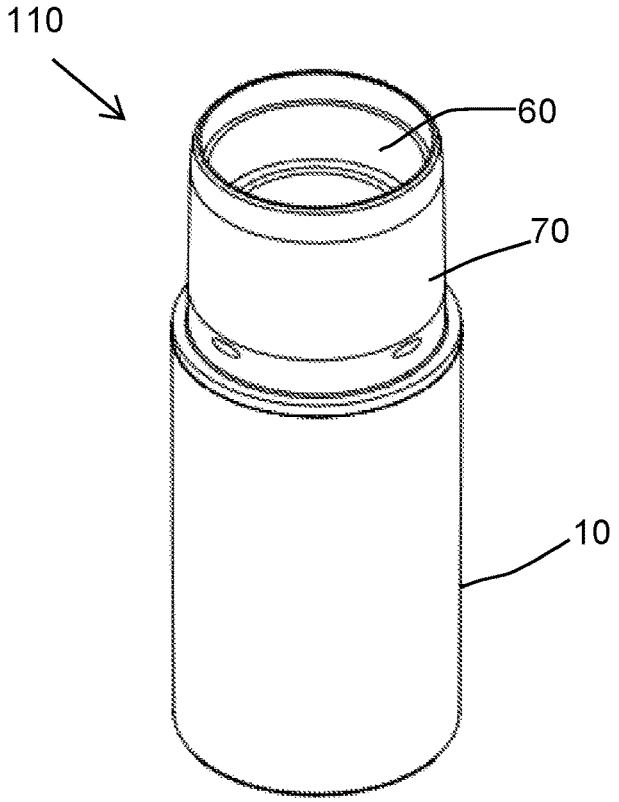
FIG. 7 shows a perspective view of a product dispensing assembly of the device of FIG. 1.

Additionally, the inner container 20 may not be made in a single piece and may comprise a tubular body whose lower end is closed by a separate bottom plug 26, as shown in FIGS. 5 and 6.

Figure 3:
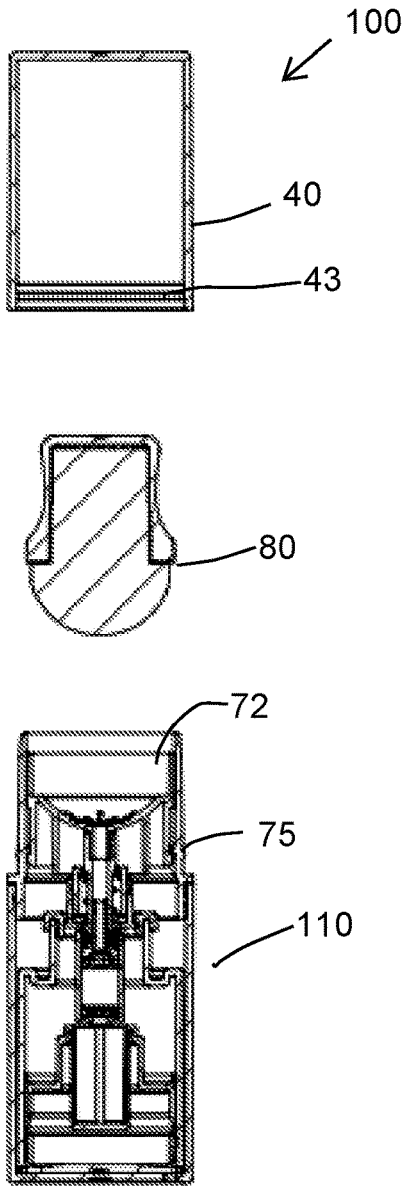
FIG. 3 shows a sectional view of the device of FIG. 2.

According to an aspect of the present disclosure, the cap 40 snap fits on the annular sleeve 70 of product dispensing assembly 110. More particularly and as shown in FIG. 3, the cap 40 comprises an annular bead 43 on an inner surface thereof that snaps onto at least one corresponding projection 75 provided on an outer surface of the annular sleeve 70. However, in alternate embodiments the cap 40 may be coupled with annular sleeve 70 by any other means of coupling such as magnetic, threads etc.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A device for dispensing and applying a product, the device comprising;

a product dispensing assembly;

an applicator configured to be coupled within an upper chamber of the product dispensing assembly in a removable manner;

a cap configured to be removably engaged with the product dispensing assembly for covering the applicator and the product dispensing assembly;

wherein the product dispensing assembly further comprises an outer container, an inner container, a pump assembly, a dispensing head, an annular sleeve, and a mounting structure;

wherein the inner container is inserted into the outer container for accommodating the product in the inner container;

wherein the annular sleeve is coupled to an upper portion of the outer container;

wherein the mounting structure is designed to fasten the pump assembly stably to a neck of the inner container;

wherein the dispensing head is coupled to an upper portion of the pump assembly such that the dispensing head extends into an inside space of the annular sleeve;

wherein an upper portion of the dispensing head and the inside space of the annular sleeve forms the upper chamber to receive and retain the applicator therein in a removable manner;

wherein the applicator of the device includes a handle and an applicator element secured to said handle;

wherein the dispensing head comprises an intermediate receiving surface with a lower skirt and an upper skirt extending substantially perpendicularly therefrom in an axial direction;

wherein the upper skirt of the dispensing head is housed within the annular sleeve;

wherein the intermediate receiving surface has at least one outlet through which the pumped product is discharged;

wherein a distal end portion of the handle of the applicator is received stably inside the annular sleeve such that the applicator element extends into the upper skirt of the dispensing head and the applicator element of the applicator is adjacent and in contact with the intermediate receiving surface and the at least one outlet of the dispensing head;

wherein the applicator is configured to slide inside the annular sleeve; and wherein when the applicator is received inside the annular sleeve, a distal end surface of the handle abuts a top edge of the upper skirt of the dispensing head.

2. A device according to claim 1, wherein the lower skirt of the dispensing head is stepped inside from the upper skirt and wherein an inner projection of the annular sleeve rests on an outer step formed on a bottom end of the annular sleeve when no downward push force is applied on the handle of the applicator.

3. A device according to claim 1, wherein when a downward push force is applied on the handle of the applicator, the applicator and the dispensing head both slide in downward direction within the annular sleeve to actuate the pump assembly.

4. A device according to claim 1, wherein the dispensing head has a product passageway which opens in the intermediate receiving surface via the at least one outlet in the intermediate receiving surface, and wherein the pump assembly is in fluid communication with the intermediate receiving surface via the product passageway and the at least one outlet when a downward push force is applied on the handle of the applicator.

5. A device according to claim 1, wherein the intermediate receiving surface is concave or of any other shape having a cavity.

6. A device according to claim 1, wherein a distal portion of the applicator element is dome in shape or any other shape having an outer surface corresponding to a surface of a cavity of the intermediate receiving surface of the dispensing head.

7. A device according to claim 1, wherein the outer container comprises an annular groove formed on an upper inner periphery thereof and configured to be coupled to a corresponding annular protrusion formed at an outer surface of a lower end portion of the annular sleeve.

8. A device according to claim 1, wherein the handle comprising a cavity and the applicator element is secured to the handle such that a proximal portion of the applicator element is received within the cavity of the handle.

9. A device according to claim 1, wherein the handle is made of a rigid material selected from a group of metal or plastic.

10. A device according to claim 1, wherein the applicator element is made of a compressible material selected from a block of open-cell foam and sponge.

11. A device according to claim 1, wherein the mounting structure includes an outer skirt, an inner skirt, a central bore, and an upper transverse flange which connects the outer skirt to the inner skirt.

12. A device according to claim 11, wherein an exterior surface of the inner skirt has a groove configured to snap-fasten with an inner bead of the neck of the inner container.

13. A device according to claim 11, wherein the outer skirt has an inner bead configured to snap-fasten with an outer groove on the neck of the inner container.

14. A device according to claim 1, wherein the pump assembly comprises a cup shaped body, a hollow elongated stem, a spring, a retaining element, a check valve, and an annular fluid-tight piston.

15. A device according to claim 14, wherein the cup shaped body comprises an outer flange which is received in an inner groove present in a central bore of the mounting structure for fixedly receiving the pump assembly in the central bore of the mounting structure.

16. A device according to claim 14, wherein an annular bead inside a central bore of the mounting structure is coupled with a corresponding groove present above an outer flange of the cup shaped body for fixedly receiving the pump assembly in the central bore of the mounting structure.

17. A device according to claim 14, wherein the hollow elongated stem of the pump assembly has, at its top mouth an annular inner protrusion for snap coupling with a corresponding outer groove in a product passageway of the dispensing head.

18. A device according to claim 14, wherein the hollow elongated stem extends at least partially into the cup-shaped body and wherein the cup-shaped body delimits a chamber for suction/compression of the product to be dispensed, and wherein the chamber is delimited by a wall of the cup-shaped body, the check valve designed to close a hole for inlet of the cosmetic product to be dispensed into said chamber from the inner container, the annular piston, and a widened end portion of the hollow elongated stem; and wherein the spring has a top end which bears upon a projecting collar of the hollow elongated stem and wherein the retaining element retains a bottom end of the spring.

19. A device according to claim 18, wherein the annular piston being mobile between a first position and a second position, wherein in the first position the dispensing head is in a non-pressed state; and wherein in the second position the dispensing head is in a pressed state by application of downward push force on the handle of the applicator.

20. A device according to claim 19, wherein when the dispensing head is in the non pressed state, the annular piston closes in a fluid-tight way, under the thrust of said spring, at least one hole traversing a thickness of the hollow elongated stem in proximity of its first end and opens into a cavity of the stem and, wherein the annular piston bears in a fluid-tight way upon the widened end portion of the hollow elongated stem and closes the cavity of the stem and blocks a connection between the chamber and the cavity of the stem itself; and wherein when the dispensing head is in the pressed state, the spring is compressed and the annular piston is raised away from the at least one hole of the hollow elongated stem and from the widened end portion, enabling the cosmetic product present in the chamber to be dispensed by passing through the hole and the cavity of the hollow elongated stem.

* * * * *